US007361058B1

(12) United States Patent
Lien et al.

(10) Patent No.: US 7,361,058 B1
(45) Date of Patent: Apr. 22, 2008

(54) ELECTRICAL INTERCONNECTING ADAPTER

(75) Inventors: Timothy J. Lien, Shawnee, KS (US); Ronald L. Carlson, Riverside, MO (US); Phu Dang, Shawnee, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 11/616,627

(22) Filed: Dec. 27, 2006

(51) Int. Cl.
*H01R 25/00* (2006.01)

(52) U.S. Cl. ..... 439/638; 439/699.1; 439/357

(58) Field of Classification Search ..... 439/619, 439/699.1, 699.2, 650–656, 638, 668, 350, 439/351, 353, 355–359
See application file for complete search history.

(56) References Cited

U.S. PATENT DOCUMENTS

| | | | | |
|---|---|---|---|---|
| 4,433,888 | A | 2/1984 | Winger | |
| 5,356,304 | A | 10/1994 | Colleran | |
| 5,454,729 | A | 10/1995 | Wen-Te | |
| 5,626,479 | A * | 5/1997 | Hughes | 439/35 |
| 6,007,362 | A | 12/1999 | Davis et al. | |
| 6,093,045 | A | 7/2000 | Hoff | |
| 6,398,579 | B1 | 6/2002 | Banas et al. | |
| 6,491,538 | B2 | 12/2002 | Fenger | |
| 6,793,513 | B2 | 9/2004 | Shibata | |
| 7,094,109 | B2 * | 8/2006 | Chou | 439/651 |
| 2002/0123262 | A1 * | 9/2002 | Andresen et al. | 439/358 |

* cited by examiner

*Primary Examiner*—Ross Gushi
(74) *Attorney, Agent, or Firm*—Shook, Hardy & Bacon L.L.P.

(57) ABSTRACT

A universal adapter enables amusement object connectors to be reliably and securely coupled with power cord receptacles of varying sizes. The adapter includes a body providing first and second end sections and conductive contact structure extending between the end sections, as well as one or more cantilevered locking arms. The first end section may be adapted for receiving a base plug of an object providing amusement effects, or may be formed as the base plug itself. The second end section is adapted to be received within the receptacle of a power cord, such that electrical contacts of the base plug and the receptacle may be electrically connected with one another through the conductive contact structure of the adapter. Each locking arm releasably engages with an outer surface of the power cord receptacle to provide a more secure connection between the adapter and the power cord receptacle.

23 Claims, 3 Drawing Sheets

ELECTRICAL INTERCONNECTING ADAPTER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to the delivery of electrical power. In particular, this invention is concerned with ensuring a proper electrical coupling between a power cord and an object utilizing electrical power.

Power or "extension" cords are commonly utilized for delivering AC or DC electrical current to various devices that consume electricity. For instance, an AC-type extension cord can be plugged into a wall outlet to deliver 110/120V electrical power supplied from the electrical utility to a consumer device plugged into the free end of the cord. Most common AC extension cord designs for consumer applications have both a standard plug-type end for connecting with a wall outlet (e.g., a 3 prong design for positive, negative, and ground leads) and a standardized receptacle end for receiving the plug of a device consuming the electricity. However, in the case of light string cords, such as those used to deliver power to multiple consumer objects providing audible and/or visual effects, i.e., "amusement" objects such as Christmas ornaments providing illumination, movement, and/or sound effects for instance, the receptacles for receiving the electrical contacts of the respective objects typically do not have a standard size. This poses a problem when a consumer attempts to plug in their amusement object to a light string receptacle. As an example, a barrel plug or other structure of the amusement object supporting the electrical contacts may not fit within or otherwise make a secure connection with the receptacle of the light string, thus rendering the amusement object useless. Furthermore, consumers purchasing light strings are often not informed as to the dimensions of the light string receptacles, and therefore cannot readily determine whether the amusement objects they possess will properly couple with the light string. Heretofore, there has been no reliable solution for ensuring that such consumer objects will be compatible with a broad range of light strings having receptacles of varying sizes, including varying diameters.

SUMMARY OF THE INVENTION

A universal adapter is provided for forming a reliable and secure electrical interconnection between a power cord and a consumer object providing amusement effects. For instance, the object receiving electrical current form the power cord may provide illumination, movement, and/or sound effects.

In one aspect, the adapter is electrically and mechanically coupled between a base plug of an object providing amusement effects and a receptacle of a power cord. The adapter, in this configuration, includes a body having first and second end sections and conductive contact structure extending between the end sections, as well as one or more cantilevered locking arms. The first end section of the body is adapted for reception of the base plug of the object and the second end section of the body is adapted to be received within the receptacle of the power cord, such that electrical contacts of the base plug and the receptacle may be electrically connected with one another through the conductive contact structure of the adapter.

In another aspect, the adapter of the present invention is formed to replace the base plug of an object providing amusement effects for connection with a receptacle of a power cord. According to this aspect, the adapter includes a body, conductive contact structure, and one or more cantilevered locking arms. The body has a first end section formed as a base plug of the object and an opposed second end section formed as a plug-type member, with the conductive contact structure extending from the first end section to the second end section. The second end section is adapted to be received within the receptacle of the power cord, such that electrical contacts of the base plug and the receptacle may be electrically connected with one another through the conductive contact structure of the adapter.

Through the various embodiments of the universal adapter of the present invention, each locking arm functions to releasably engage with an outer surface of the power cord receptacle to provide a more secure connection between the adapter and the power cord receptacle. This is especially advantageous when a secure connection between a power cord and an object providing amusement effects is sought for power cords having receptacles of varying sizes.

Additional advantages and features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 1:
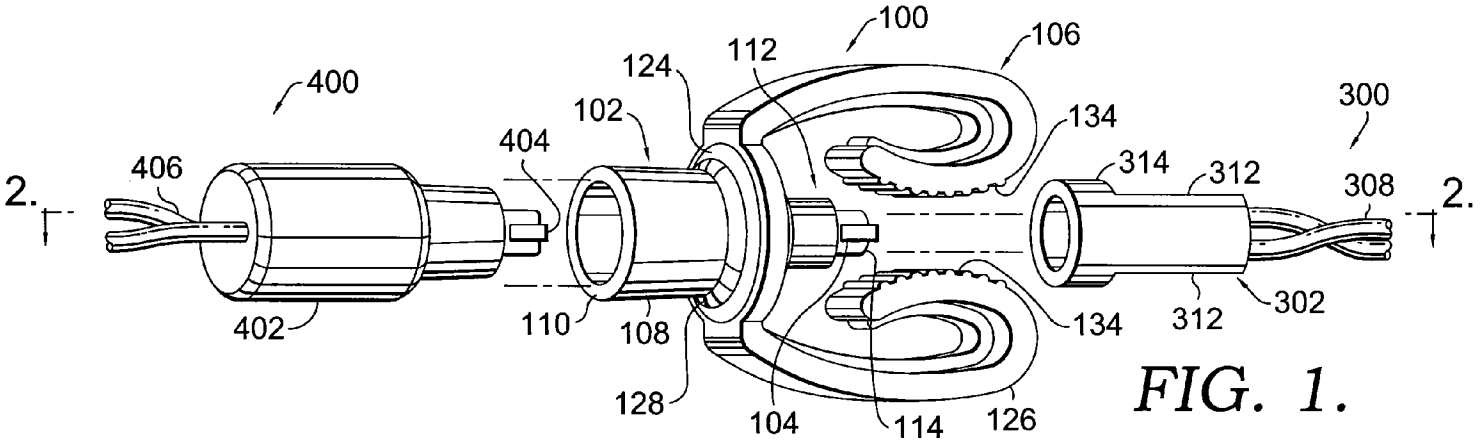
FIG. 1 is a perspective view of one embodiment of the universal adapter of the present invention shown in alignment for assembly with both a connector of an object providing amusement effects and a power cord receptacle.

Referring now in more detail to the drawing figures, and initially FIG. 1, one embodiment of a universal adapter of the present invention is designated by reference numeral 100. One particular application for the universal adapter 100 illustrated in FIG. 1 is to interconnect a light string-type power cord 300 with a connector 400 of a consumer object providing amusement effects. This enables electrical power supplied by the power cord 300 to flow to the consumer object for generation of illumination, movement, and/or sound effects, for instance. More specifically, the universal adapter 100 is configured to electrically couple and provide a secure connection with a receptacle 302 of the power cord 300 on one side, while likewise electrically coupling and providing a secure connection with the object connector 400 on an opposing side. Particular exemplary constructions for the power cord receptacle 302 and the object connector 400 in the form of a base or "barrel" plug 402, as well as more detail of the universal adapter 100 components, can be seen with additional reference to FIG. 2.

The universal adapter 100 is generally formed by a hollow body 102, conductive contacts 104 extending through the body 102 for electrically coupling with corresponding conductive members, or leads 304 and 404, of the power cord receptacle 302 and barrel plug 402, respectively, and a locking arm structure 106. A socket-type member 108 is formed in the region of a first longitudinal end 110 of the body 102 for receiving the barrel plug 402 therein. Likewise, a plug-type member 112 is formed in the region of a second, opposed longitudinal end 114 of the body 102 for being received within the power cord receptacle 302. As explained in further detail below, the socket-type member 108 generally has an internal cross-sectional dimension, or diameter, and a conductive contact 104 arrangement selected for producing a friction fit and reliable electrical coupling between the adapter 100 and the barrel plug 402 of the consumer object. However, because there is often significant variance in the internal diameter of commercially available light string-type power cord receptacles 302, as defined by its inner wall 306, a friction fit between the structure of the plug-type member 112 and the internal wall 306 of any given power cord receptacle 302 is more difficult to obtain. Accordingly, the adapter 100 employs the locking arm structure 106 to provide one or both of a friction fit and a structural interference between the adapter 100 and a given power cord receptacle 302 to inhibit the separation of the plug-type member 112 from the receptacle 302 and thus the decoupling of the conductive contacts 104 from the conductive leads 304 of the receptacle 302.

Figure 2:
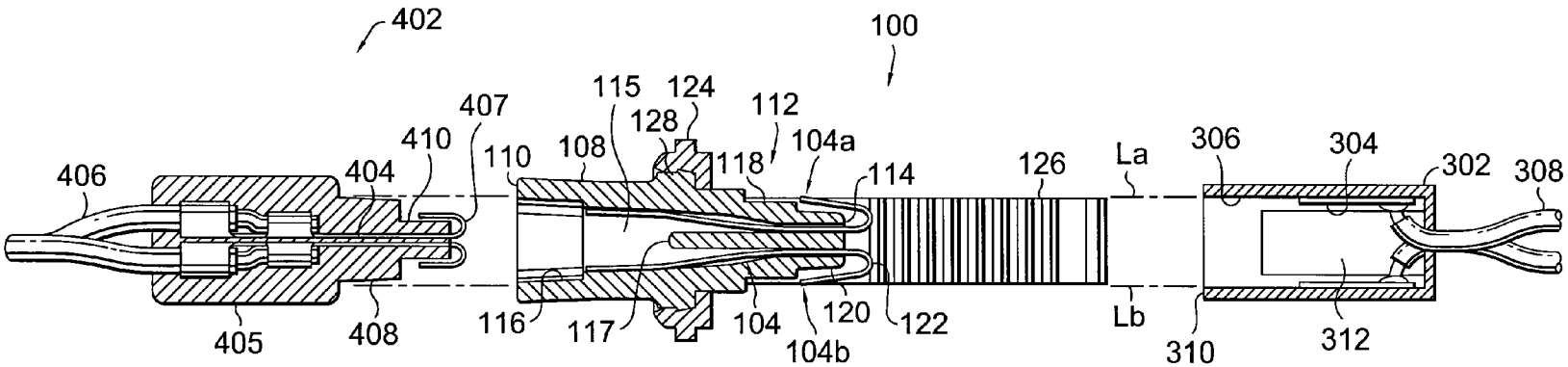
FIG. 2 is a cross-sectional view taken along line 2-2 of FIG. 1.

With continued reference to FIGS. 1 and 2, a pair of conductive wires 406 terminate at an electrical connection with the conductive leads 404 within a base housing 405 of the barrel plug 402 to deliver electrical current to the consumer object (not shown), as is known in the art. To facilitate the friction fit with the barrel plug 402, the internal diameter of the socket-type member 108 proximal to the first longitudinal end 110 of the body 102 is preferably selected to be almost the same as the outside diameter of a first stub portion 408 of the barrel plug 402. Similarly, the internal diameter of the socket-type member 108 in an inner region 115 of the body 102 where the conductive contacts 104 are aligned with the internal wall 116 is preferably selected to be slightly larger than the outside diameter of a second stub portion 410 of the plug 402 where return bends 407 of the conductive leads 404 are exposed. Additionally, a projection 117 is formed within the body inner region 115 of the adapter 100 to urge the conductive lead return bends 407 away from each other and towards the internal wall 116 and into engagement with the conductive contacts 104 when the plug 402 is fully inserted in the socket-type member 108. As such, the friction fit between the conductive lead return bends 407 and the conductive contacts 104 in the body inner region 115, and between the first stub portion 408 and the internal wall of the socket-type member 108 proximal to the body first longitudinal end 110, ensure a firm mechanical and electrical connection between the barrel plug 402 and the adapter 100.

Similar to the consumer object connector 400, the power cord 300 includes a pair of conductive wires 308 terminating at an electrical connection with the conductive leads 304 within the power cord receptacle 302 to deliver electrical current to the conductive contacts 104 of the adapter 100 when connected therewith. However, unlike the condition where an outside diameter of portions of the barrel plug 402 are known, the internal diameter of the receptacle 302 measured at the internal wall 306 often varies within a general range depending on the manufacturer of the particular power cord 300 selected. Accordingly, the plug-type member 112 is formed with a first engaging portion 118 sized to fit within the smallest receptacle 302 internal diameter measured at the internal wall 306 for a given range of receptacle diameter sizes. The plug-type member 112 terminates at a second engaging portion 120 extending generally axially from the first engaging portion 118 and supporting the conductive contacts 104 in electrical connection with the conductive leads 304 of the power cord receptacle 302 when the plug-type member 112 is fully inserted into the receptacle 302. The conductive contacts 104 preferably take the form of a positive conductive contact member 104*a* and a negative conductive contact member 104*b*. The pair of conductive contact members 104*a* and 104*b* extending through either a collective opening or individual openings formed in the second longitudinal end 114 of the body 102 at the plug-type member 112. In this arrangement, members 104*a* and 104*b* function to complete the circuit with the positive and negative conductive leads 304 and 404 of the power cord receptacle 302 and barrel plug 402, respectively. The members 104*a* and 104*b* are each formed with a return bend 122, enabling the conductive contact members 104*a* and 104*b* to collectively span different cross-sectional dimensions depending on size of the diameter of the receptacle 302 where the conductive leads 304 are located.

More specifically, when the conductive contact members 104*a* and 104*b* are in the unbiased position seen in FIG. 2, the members 104*a* and 104*b* span a distance between the lines $L_a$ and $L_b$. Upon insertion of the plug-type member 112 into the power cord receptacle 302, the return bends 122 allow the members 104*a* and 104*b* to be inwardly displaced by the constricted diameter of the receptacle 302 at the conductive leads 304 to a degree limited by the diameter of the second engaging portion 120. By this arrangement, a solid electrical connection between the adapter conductive contacts 104 and the power cord conductive leads 304 is likewise maintained.

As stated above, the locking arm structure 106 provides the secure connection between the adapter 100 and the power cord receptacle 302, so that the friction fit between the adapter conductive contacts 104 (i.e., the conductive contact members 104*a* and 104*b*) and the power cord receptacle conductive leads 304 is not relied upon to provide the primary mechanical connection between the adapter 100 and the receptacle 302. With reference to FIG. 1 and additional reference to FIG. 6, the locking arm structure 106 includes a collar 124 and a pair of generally opposed cantilevered locking arms 126 for engaging with opposed recessed surfaces 312 and corresponding shoulder members 314 of the receptacle 302. The collar 124 is fitted onto a mounting seat 128 circumscribing the body 102 generally at the juncture between the socket-type member 108 and the plug-type member 112.

The locking arms 126 extend outwardly away from the body 102 and the collar 124 with a curvilinear shape and generally in a plane aligned with the longitudinal axis of the plug-type member 112. Continuing along the length of the locking arms 126, each arm 126 then curves inwardly back towards the longitudinal axis of the plug-type member 112 at a return bend 130 and continues to change direction until the arm begins to extend in the opposite direction back towards the collar 124 at an end flange 132. The end flanges 132 of the locking arms 126 present contact surfaces 134 that face one another and define therebetween a clearance space.

Figure 6:
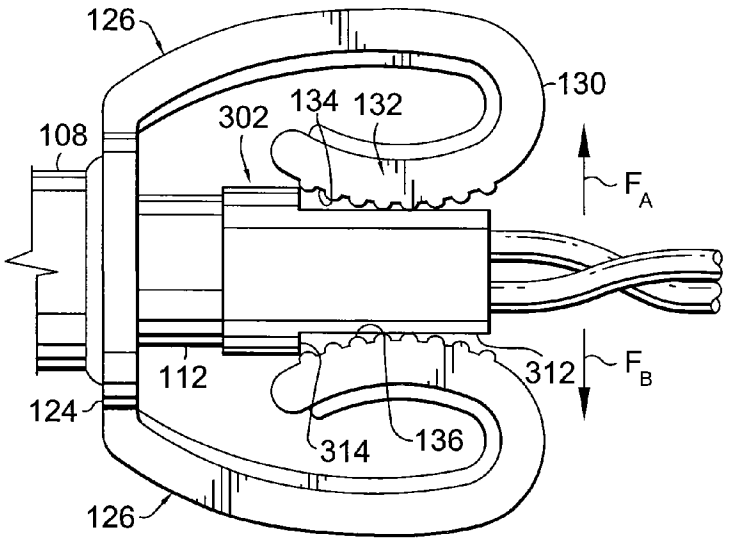
FIG. 6 is an enlarged fragmentary perspective view of the universal adapter of the present invention coupled with a power cord receptacle.
Figure 5:
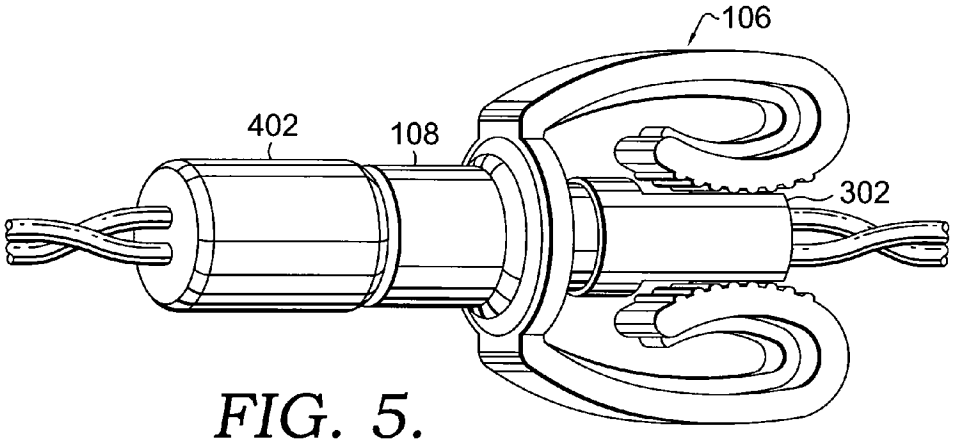
FIG. 5 is a perspective view of the embodiment of FIG. 1 showing the universal adapter of the present invention in an assembled/use position and showing the interconnection between the universal adapter, the connector of the object providing amusement effects and the power cord receptacle.

The locking arms 126 are preferably configured to present a clearance space measured orthogonally to the longitudinal axis of the plug-type member 112 that is smaller than the largest expected outside diameter of a power cord receptacle 302 to be connected with the adapter 100. Accordingly, when the plug-type member 112 is being inserted into the power cord receptacle 302 to electrically couple the adapter 100 with the power cord 300, the user will simultaneously place a separation force on the locking arms 126 in the direction of the arrows $F_A$ and $F_B$, to increase the dimension of the clearance space between the contact surfaces 134 beyond the outside diameter of the receptacle 302 at the shoulder members 314. Upon inserting the plug-type member 112 a sufficient distance into the receptacle 302 to move the contact surfaces 134 at least to the longitudinal position of the shoulder members 314 (and preferably past the members 314 for alignment with the opposed recessed surfaces 312), the user can then release the separation force on the locking arms 126. At this point, the contact surfaces 134 of the locking arms 126 are either fully seated on the recessed surfaces 312 of the receptacle 302 or are frictionally engaging with the shoulder members 314, whereby further urging of the plug-type member 112 longitudinally into the receptacle 302 causes the contact surfaces 134 to slide over the shoulder members 314 and onto the recessed surfaces 312. Through the steps, the adapter 100 and the power cord receptacle 302 become interlocked with one another, as shown in FIGS. 5 and 6. This interlocking occurs because there is insufficient clearance space between the contact surfaces 134 to move the locking arms 126 back past the shoulder members 314. Additionally, each contact surface 134 can have a plurality of raised members 136, such as a series of separated ridges, in order to increase the structural interference between the locking arms 126 and the shoulder members 314 of the receptacle 302. These above steps may be reversed in order to separate the adapter 100 and the power cord receptacle 302. For instance, the user can again apply a separation force to the locking arms 126, in the direction of the arrows $F_A$ and $F_B$, while simultaneously pulling the adapter 100 longitudinally away from the receptacle 302. Once again, the separation force should be sufficient to increase the dimension of the clearance space between the contact surfaces 134 beyond the outside diameter of the receptacle 302 at the shoulder members 314.

Figure 3:
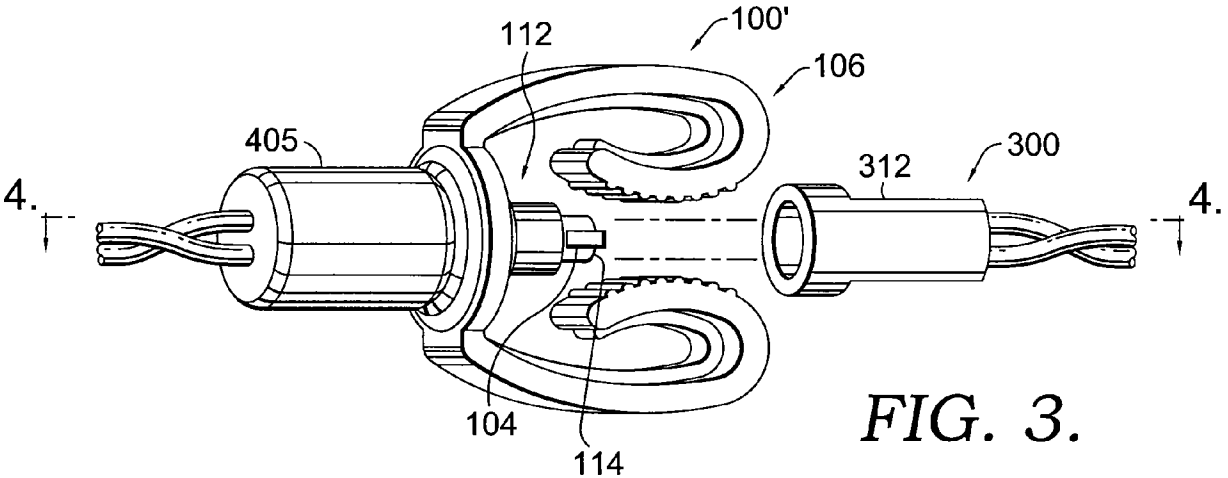
FIG. 3 is a perspective view of another embodiment of the universal adapter of the present invention shown in alignment for assembly with a power cord receptacle.
Figure 4:
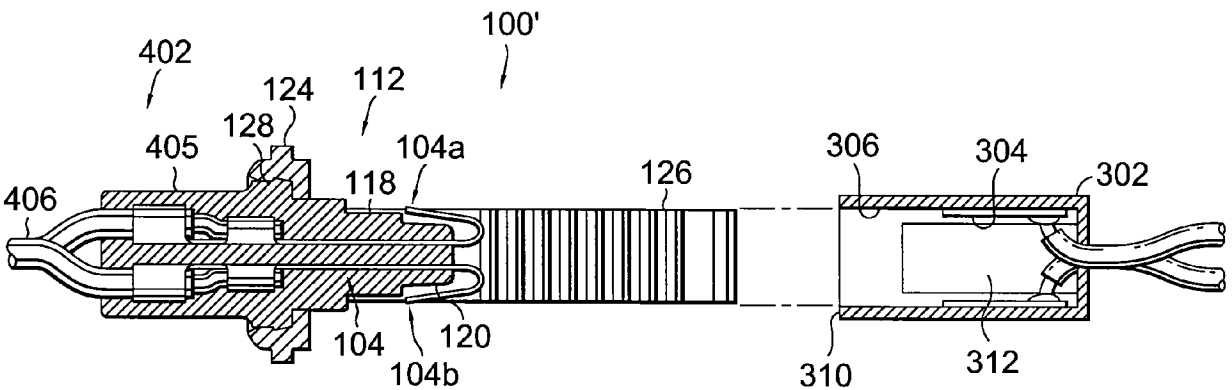
FIG. 4 is a cross-sectional view taken along line 4-4 of FIG. 3.

Turning to FIGS. 3 and 4, another embodiment of the universal adapter 100' is depicted. As can be seen, the hollow body 102 of the adapter 100', specifically, the plug-type member 112 and the mounting seat 128 for the locking arms 126, is integrated with the base housing 405 of the consumer object barrel plug 402. In this way, the universal adapter 100' is formed as a part of the consumer object connector 400 for securely mating with the power cord receptacle 302.

As can be seen in FIG. 4, the conductive wires 406 terminate within the base housing 405 at an electrical connection with the conductive contacts 104 (i.e., conductive contact members 104*a* and 104*b*). The conductive contacts 104 also extend through the first and second engaging portions 118 and 120 of the plug-type member 112, and are thus supported by the second engaging portion 120 in electrical connection with the conductive leads 304 of the receptacle 302. The mounting seat 128 is formed on the base housing 405 in circumscribing fashion and serves to support the collar 124 of the locking arm structure 106. The locking arms 126 take the same configuration on the adapter 100' as with the universal adapter 100 of FIGS. 1 and 2, and thus extend generally in a plane aligned with the longitudinal axis of the plug-type member 112 for presenting contact surfaces 134 and a respective clearance space for proper engagement with the recessed surfaces 312 of the power cord receptacle 302.

It should be understood that various embodiments of the universal adapter 100 and 100' may have any number of cantilevered locking arms 126. Furthermore, such locking arms 126 may be spaced evenly or non-evenly about the circumference of the collar 124 for engaging with the recessed surfaces 312 of the receptacle 302 for a structural interference fit or merely another location on the outside surface of the receptacle 302 for a friction fit. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. An adapter for interconnecting a power cord having a receptacle with an object providing amusement effects and having a base plug, comprising:

a body having an outer surface, a mounting seat circumscribing the outer surface, a first end section formed as a socket-type member and an opposed second end section formed as a plug-type member, wherein the first end section is adapted to receive therein the base plug of the object and the second end section is adapted to be received within the receptacle of the power cord;

conductive contact structure extending from the first end section to the second end section of the body;

two or more cantilevered locking arms having base portions and being adapted to be positioned generally adjacent to the second end section; and a collar fitted onto the mounting seat of the body outer surface and joining together the two or more cantilevered locking arms at the base portions thereof;

whereby upon inserting the base plug of the object within the first end section of the body and inserting the second end section of the body within the receptacle of the power cord, each locking arm releasably engages with an outer surface of the power cord receptacle while the conductive contact structure delivers electrical power from conductive members of the power cord to conductive members of the object.

2. The adapter of claim 1, wherein each locking arm of the two or more cantilevered locking arms extends outwardly away from the body with a curvilinear shape and then back towards the body via a curved return bend to an end flange, and wherein a contact surface is presented by the end flange for engaging with the outer surface of the power cord receptacle upon the second end section of the body being inserted into the receptacle of the power cord.

3. The adapter of claim 1, wherein the two or more locking arms comprise a pair of locking arms positioned in opposition to one another about the body to form a clearance space between the respective locking arms at a rest position, the pair of locking arms being biased toward one another upon a separation force being applied to the locking arms to increase the dimension of the clearance space.

4. The adapter of claim 1, wherein each locking arm of the two or more cantilevered locking arms has a curved contact surface for engaging with the outer surface of the power cord receptacle upon the second end section of the body being inserted into the receptacle of the power cord, the contact surface including a series of separated ridges.

5. The adapter of claim 1, wherein the conductive contact structure includes a pair of conductive contact members emerging from within and extending outside of the body at the second end section thereof, each conductive contact member presenting a return bend located outwardly proximal to the body second end section.

6. An adapter for interconnecting a power cord having a receptacle with an object providing amusement effects, comprising:

a body having an outer surface, a mounting seat circumscribing the outer surface, a first end section formed as a base plug of the object providing amusement effects and an opposed second end section formed as a plug-type member, wherein the second end section is adapted to be received within the receptacle of the power cord;

conductive contact structure extending from the first end section to the second end section of the body, the conductive contact structure including a pair of conductive contact members extending from electrical leads of the object;

two or more cantilevered locking arms having base portions and being adapted to be positioned generally adjacent to the second end section; and a collar fitted onto the mounting seat of the body outer surface and joining together the two or more cantilevered locking arms at the base portions thereof;

whereby upon inserting the second end section of the body within the receptacle of the power cord, each locking arm releasably engages with an outer surface of the power cord receptacle while the conductive contact structure delivers electrical power from the power cord to the object via the pair of conductive contact members engaging with conductive members of the power cord.

7. The adapter of claim 6, wherein each locking arm of the two or more cantilevered locking arms extends outwardly away from the body with a curvilinear shape and then back towards the body via a curved return bend to an end flange, and wherein a contact surface is presented by the end flange for engaging with the outer surface of the power cord receptacle upon the second end section of the body being inserted into the receptacle of the power cord.

8. The adapter of claim 6, wherein the pair of conductive contact members emerge from within and extend outside of the body at the second end section thereof, each conductive contact member presenting a return bend located outwardly proximal to the body second end section.

9. The adapter of claim 6, wherein each locking arm of the two or more cantilevered locking arms has a curved contact surface for engaging with the outer surface of the power cord receptacle upon the second end section of the body being inserted into the receptacle of the power cord, the contact surface including a series of separated ridges.

10. An electrical adapter comprising:

a body formed with a plug-type end having at least one opening, and a passageway extending within the body to the at least one opening of the plug-type end;

conductive contact structure extending at least partially within the passageway of the body to the at least one opening of the plug-type end; and two or more cantilevered locking arms, each locking arm extending outwardly away from the body with a curvilinear shape and then back towards the body via a curved return bend to an end flange, and wherein a contact surface is presented by the end flange;

whereby upon inserting the plug-type end of the body within a receptacle of a power cord possessing conductive leads, each locking arm contact surface releasably engages with an outer surface of the power cord receptacle while the conductive contact structure electrically couples with the conductive leads of the power cord receptacle.

11. The adapter of claim 10, wherein the body is further formed with a socket-type end opposing the plug-type end for receiving therein the base plug of an object providing amusement effects, the conductive contact structure extending to the socket-type end to electrically couple the conductive leads of the power cord receptacle with conductive leads of the base plug of the object upon inserting the plug-type end of the body within the power cord receptacle and inserting the base plug of the object within the socket-type end of the body.

12. The adapter of claim 11, wherein the two or more locking arms comprises a pair of locking arms positioned in opposition to one another about the body to form a clearance space between the respective locking arms at a rest position, the pair of locking arms being biased toward one another upon a separation force being applied to the locking arms to increase the dimension of the clearance space.

13. The adapter of claim 11, wherein the body is formed with an outer surface and a mounting seat circumscribing the outer surface, and wherein the two or more cantilevered locking arms are joined together at base portions thereof by a collar fitted onto the mounting seat of the body outer surface.

14. The adapter of claim 11, wherein the curved contact surface of each locking arm of the two or more cantilevered locking arms includes a series of separated ridges.

15. The adapter of claim 11, wherein the conductive contact structure includes a pair of conductive contact members emerging from within and extending outside of the body at the plug-type end thereof, each conductive contact member presenting a return bend located outwardly proximal to the plug-type end.

16. The adapter of claim 10, wherein the body has a portion formed as a base plug of an object providing amusement effects such that insertion of the plug-type end of the body within the power cord receptacle causes the conductive contact structure to electrically couple the power cord with the object.

17. The adapter of claim 16, wherein the two or more locking arms comprises a pair of locking arms positioned in opposition to one another about the body to form a clearance space between the respective locking arms at a rest position, the pair of locking arms being biased toward one another upon a separation force being applied to the locking arms to increase the dimension of the clearance space.

18. The adapter of claim 16, wherein the body is formed with an outer surface and a mounting seat circumscribing the outer surface, and wherein the two or more cantilevered locking arms are joined together at base portions thereof by a collar fitted onto the mounting seat of the body outer surface.

19. The adapter of claim 16, wherein the curved contact surface of each locking arm of the two or more cantilevered locking arms includes a series of separated ridges.

20. The adapter of claim 16, wherein the conductive contact structure includes a pair of conductive contact members emerging from within and extending outside of the body at the plug-type end thereof, each conductive contact member presenting a return bend located outwardly proximal to the plug-type end.

21. An electrical adapter comprising:

a body formed with a plug-type end having at least one opening, and a passageway extending within the body to the at least one opening of the plug-type end;

a pair of conductive contact members extending at least partially within the passageway of the body and emerging therefrom through the at least one opening of the plug-type end, each conductive contact member presenting a return bend located outwardly proximal to the plug-type end; and two or more cantilevered locking arms each presenting a contact surface and adapted to be positioned generally adjacent to the plug type end;

whereby upon inserting the plug-type end of the body within a receptacle of a power cord possessing conductive leads, each locking arm contact surface releasably engages with an outer surface of the power cord receptacle while the pair of conductive contact members electrically couples with the conductive leads of the power cord receptacle.

22. The adapter of claim 21, wherein each locking arm of the two or more cantilevered locking arms extends outwardly away from the body with a curvilinear shape and then back towards the body via a curved return bend to an end flange, and wherein the contact surface is located on the end flange.

23. The adapter of claim 21, wherein the body is formed with an outer surface and a mounting seat circumscribing the outer surface, and wherein the two or more cantilevered locking arms are joined together at base portions thereof by a collar fitted onto the mounting seat of the body outer surface.

* * * * *